US005139357A

United States Patent [19]

Reents

[11] Patent Number: 5,139,357

[45] Date of Patent: Aug. 18, 1992

[54] AIR ACTUATED SWITCH FOR PAINTING SYSTEM

[75] Inventor: Terry R. Reents, Burnsville, Minn.

[73] Assignee: Wagner Spray Tech Corporation, Minneapolis, Minn.

[21] Appl. No.: 710,384

[22] Filed: Jun. 5, 1991

Related U.S. Application Data

[63] Continuation of Ser. No. 391,447, Aug. 9, 1989, abandoned, which is a continuation-in-part of Ser. No. 260,523, Oct. 21, 1988, abandoned.

[51] Int. Cl.[5] ..... A46B 11/02; H01H 35/34; H01H 35/26

[52] U.S. Cl. ..... 401/146; 200/81 H; 200/83 P; 200/83 Z; 401/188 R

[58] Field of Search ..... 401/188 R, 146; 200/81 H, 83 Z, 83 P

[56] References Cited

U.S. PATENT DOCUMENTS

| | | | |
|---|---|---|---|
| 1,963,864 | 6/1934 | Oweger et al. | 200/83 P |
| 2,623,963 | 12/1952 | Wolfe et al. | 200/83 P |
| 3,046,368 | 7/1962 | Kaminky | 200/83 PX |
| 3,195,170 | 7/1965 | Howard . | |
| 3,230,328 | 1/1966 | Chapin | 200/83 P |
| 3,244,831 | 4/1966 | Rhodes et al. | 200/83 P |
| 3,773,991 | 11/1973 | Krieger et al. | 200/83.2 |
| 3,873,790 | 3/1975 | Coons . | |
| 4,540,301 | 9/1985 | Swanson et al. . | |
| 4,639,156 | 1/1987 | Stern et al. | 401/146 |
| 4,647,738 | 3/1987 | Diamond . | |

FOREIGN PATENT DOCUMENTS

| | | | |
|---|---|---|---|
| 1296033 | 11/1972 | United Kingdom | 200/81 H |
| 2097007 | 10/1982 | United Kingdom | 401/188 R |

*Primary Examiner*—Steven A. Bratlie
*Attorney, Agent, or Firm*—Faegre & Benson

[57] ABSTRACT

An improved pneumatic actuator for an electrical switch having a flexible diaphragm operating through a rigid disk member actuates an electrical contact when air pressure is applied to the diaphragm. A cylindrical ring acts as a guide for the rigid disk member. The rigid disk member serves to flatten the membrane and resist permanent deformation when air pressure is released from the membrane.

12 Claims, 4 Drawing Sheets 18
34
50
20
56
30
58
96
75
68
70
72
92
94
62
64
77
66
60
76
98
90
74
71
79
54
80
78
86
88
82
84

AIR ACTUATED SWITCH FOR PAINTING SYSTEM

CROSS REFERENCE TO RELATED APPLICATION

This is a continuation of co-pending application Ser. No. 07/391,447, filed Aug. 9, 1989, which is a continuation-in-part of application Ser. No. 07/260,523, filed on Oct. 21, 1988, both now abandoned.

BACKGROUND OF THE INVENTION

This invention relates to remotely operated electric switches, more particularly switches having a pneumatic link between a manual operator and a switch actuator.

In the past, it has been known to use pneumatic links for remote actuation of electrical switches. Prior art approaches have utilized a pneumatically driven membrane to actuate an electrical switch. Such approaches have typically suffered from a characteristic lack of gain necessitating excessive operator travel which is undesirable from the viewpoint of a human operator.

The present invention overcomes disadvantages of the prior art by providing a pneumatic link open to the atmosphere except when the switch is actuated, and which has a motion amplifying structure at the electrical switch actuating membrane having relatively few parts, resulting in reduced cost and complexity while at the same time providing efficient and reliable switch actuation.

DETAILED DESCRIPTION

Figure 1:
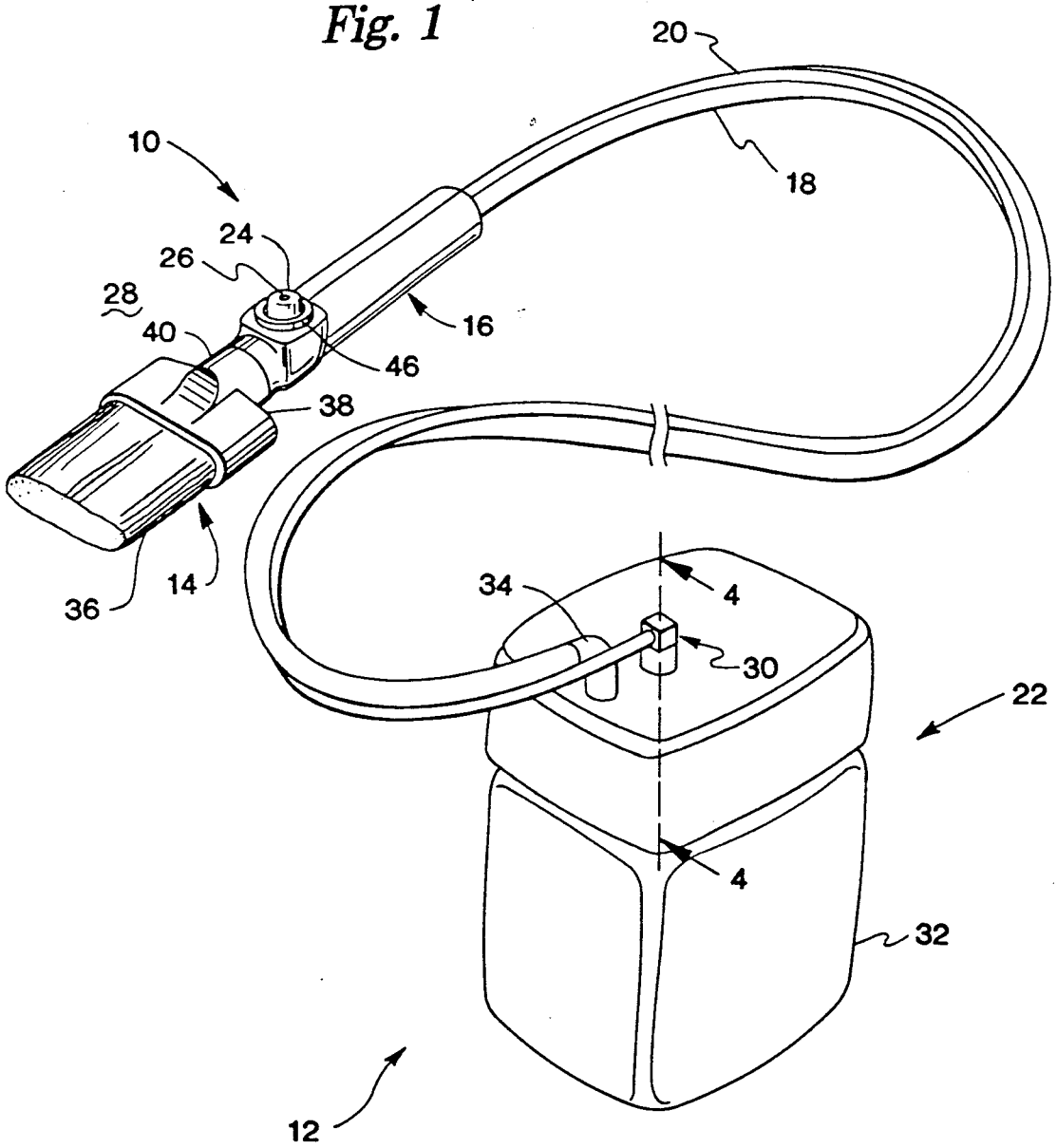
FIG. 1 is a perspective view of the air actuated switch utilized in a portable painting apparatus.

Referring now to FIG. 1, an air actuated switch 10 may be seen in an environment of a portable painting system 12. System 12 includes an applicator or brush 14, a handle 16, a paint supply line 18, a switch control line 20, and a paint reservoir and pump 22. System 12 is utilized by grasping handle 16 such that a thumb or finger may be conveniently placed in manual contact with a resiliently deformable operator or button 24. Button 24 is formed with an aperture 26 venting the interior of line 20 to ambient atmosphere. Line 20 is coupled to a switch (see FIGS. 4 and 5) via a fitting 30. Depression of button 24 actuates a pump (not shown) and causes paint to be drawn from reservoir 32 through fitting 34, handle 16 to be delivered to brush 14. The paint is preferably delivered to the interior of bristles 36 and is thus available for application to a desired surface (not shown).

Figure 2:
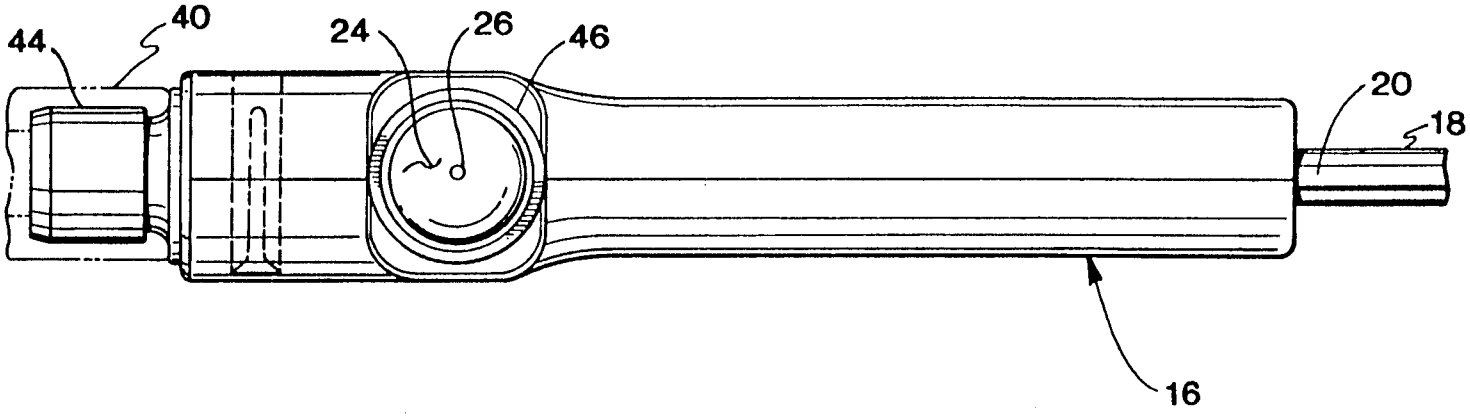
FIG. 2 is a fragmentary top plan view of the handle of FIG. 1.
Figure 3:
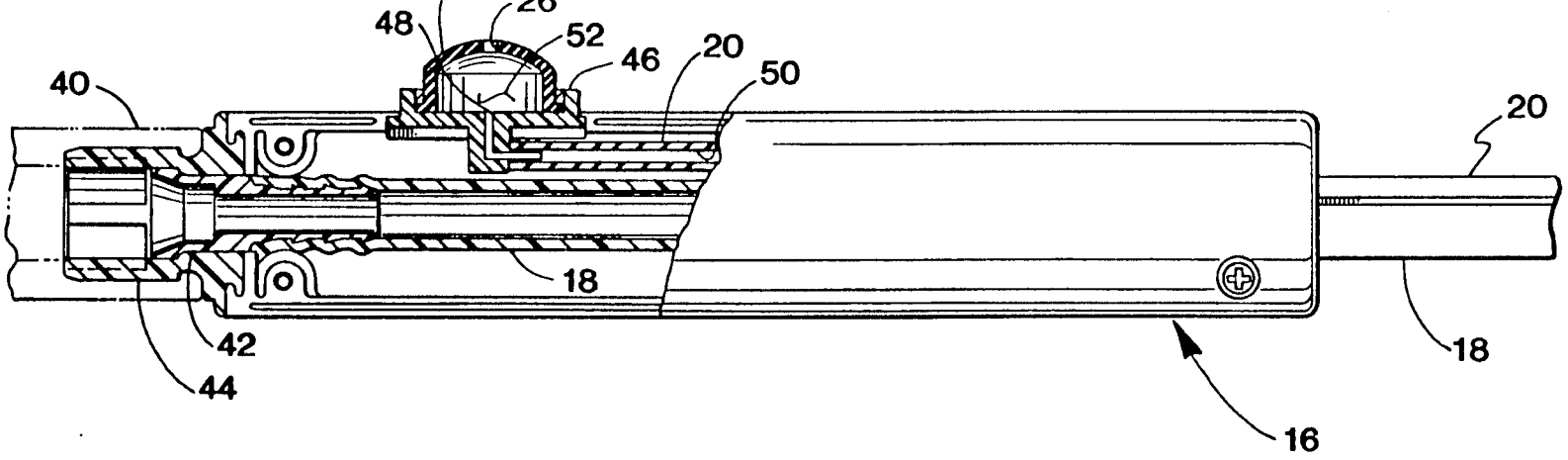
FIG. 3 is a fragmentary side elevation view of the handle of FIG. 2 with parts cut away.

Referring now also to FIGS. 2 and 3, bristles 36 are preferably held in a ferrule 38 having a projecting end 40 adapted to be mated with handle 16. Paint supply line 18 is preferably received on a barbed fitting 42 which is received in and mates with a projection 44 at the brush end of handle 16. The paint is supplied through the interior of line 18 through fitting 42 and projection 44 to the interior of ferrule 38.

Button 24 is received and retained in a rigid base 46 carried by handle 16. Base 46 has an air passageway 48 in communication with an air passageway 50 of line 20.

When button 24 is contacted and depressed, aperture 26 is closed and the interior 52 of button 24, and air passageways 48, 50 are pressurized.

Figure 4:
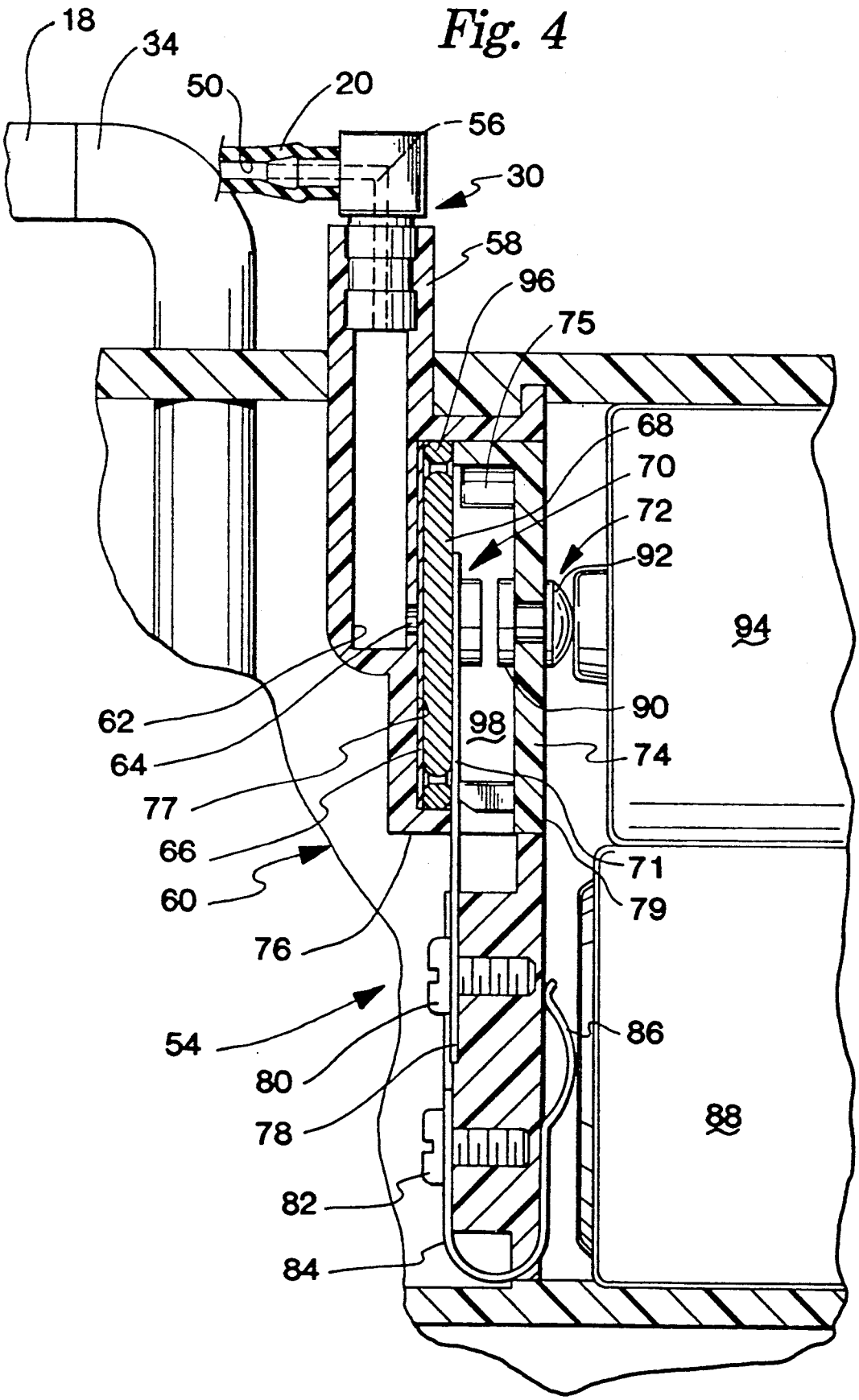
FIG. 4 is a fragmentary section detail taken along line 4—4 of FIG. 1, slightly enlarged.
Figure 5:
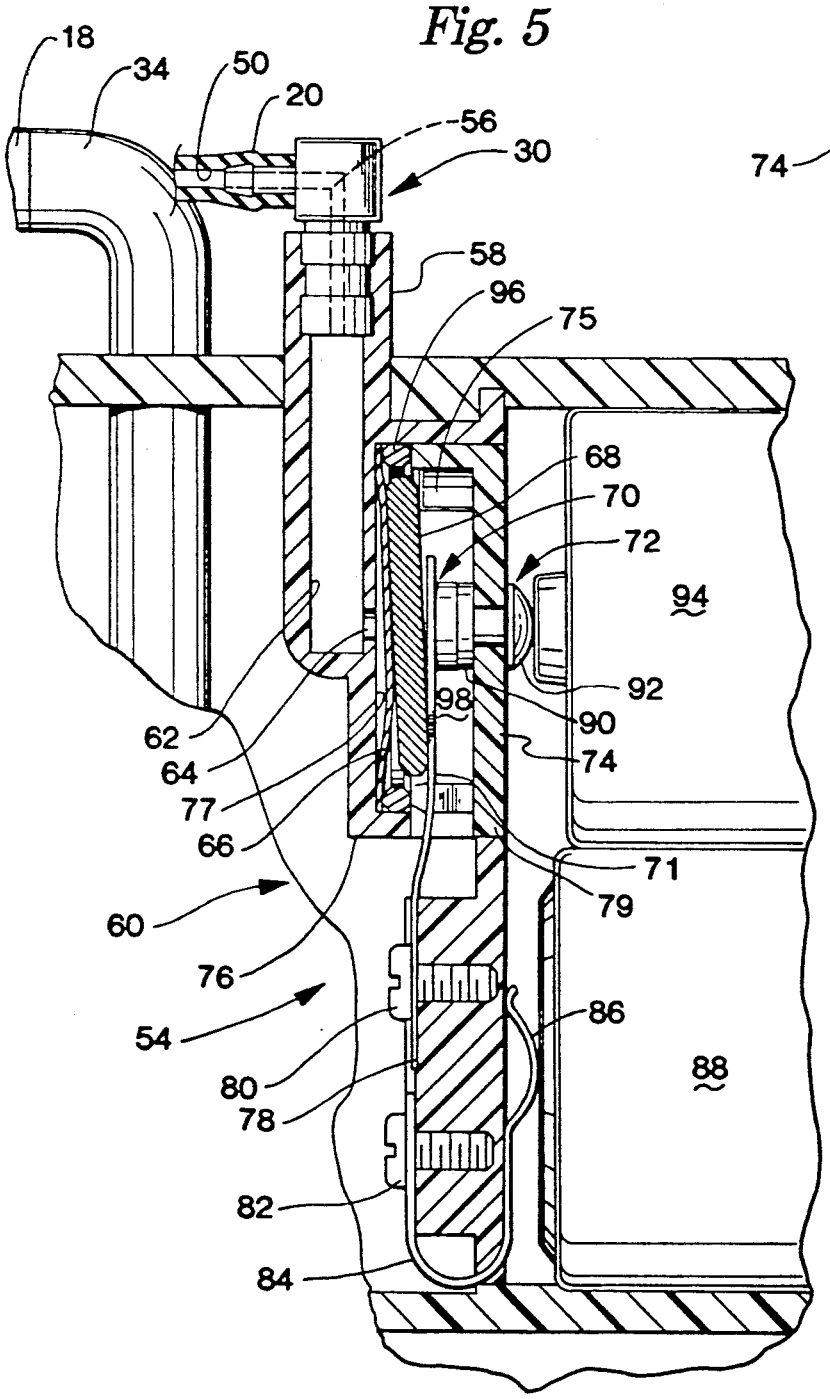
FIG. 5 is a view similar to that of FIG. 4, but with parts shown in the switch-actuated position.

Referring now also to FIGS. 4 and 5, an electrical switch 54 may be seen. Switch 54 is actuable via air passageway 50 and fitting 30 which has an air passageway 56 in communication with air passageway 50. Fitting 30 is preferably received in a projection 58 of a switch housing 60.

Switch housing 60 includes an air passageway 62 and a vent 64. When button 24 is depressed, the air pressure in passageway 62 is elevated above ambient air pressure, and is allowed to act against a membrane 66 via vent 64. It is to be understood that membrane 66 provides a "closed" environment for the air in passageway 62. A disk 68 is positioned in between membrane 66 and a movable contact 70. A fixed contact 72 is located in a cover portion 74 of switch housing 60. It is to be understood that cover portion 74 may be press-fit or ultrasonically welded or secured to a base portion 76 of switch housing 60 by any conventional means. Contact 70 is preferably secured to base portion 76 by a machine screw 80, which can also serve to secure a wire to attachment portion 78, if desired. A second machine screw 82 preferably secures an electrical clip 84 to base portion 76. Clip 84 preferably has a resilient portion 86 adapted to make contact with a battery 88. Contact 72 preferably has a first portion 90 for making an electrical connection with contact 70, and a second portion 92 for making contact with a battery 94. It is to be understood that it is preferable that base portion 76 and cover portion 74 are preferably formed of an electrically insulating material, such as plastic. A ring 96 is preferably located concentric to disk 68 to position disk 68 in a cavity 98 of switch housing 60.

Figure 6:
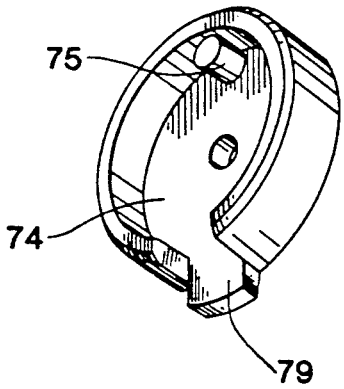
FIG. 6 is a view of a switch cover useful in the practice of this invention.

Referring now also to FIG. 6, cover portion 74 preferably has a plastic pin or projection 75 to act as a fulcrum for disk 68, as shown more clearly in FIG. 5. Cover portion 74 also preferably has a tongue or key 79 diametrically opposite pin 75 to position pin 75 with respect to leaf-spring portion 71 of contact 70. Disk 68 pivots against pin 75 when urged by membrane 66. Disk 68 acts against leaf-spring portion 71 of contact 70 to cause contacts 70, 72 to form a closed circuit while in the actuated condition.

Disk 68 may thus be seen to amplify movement of membrane 66, causing a more positive and efficient actuation of contacts 70, 72. Disk 68 also functions to retard permanent deformation of membrane 66 while in the deactuated condition as shown in FIG. 4.

It is to be understood that absent disk 68, membrane 66 may gradually take a permanent set or deformation, resulting in deterioration or failure of the operation of membrane 66 to actuate switch 54. Disk 68 restores membrane 66 by "ironing" or flattening it against a back wall 77 of base portion 76 when urged to do so by contact 70 in its deactuated state as shown in FIG. 4.

Disk 68 preferably has a close, but positive clearance with ring 96; for example disk 68 may be 0.900"+0.005"

while ring 96 may have a 0.940" inside diameter with a tolerance of ±0.002."

Ring 96 is preferably sized to be of reduced thickness with respect to disk 68, for example disk 68 may be 0.100" +0.005" while ring 96 may be 0.095"±0.002," pressed into a 0.010" recess in base portion 76 to retain membrane 66.

Disk 68 further provides the feature of providing a bearing surface to distribute the load of contact 70 on membrane 66. Disk 68 thus protects membrane 66 from concentrated wear from contact 70.

In operation, switch 54 is actuated by manually contacting and deforming operator 24, closing off aperture 26 from ambient atmosphere 28, and pressurizing the interior air space of passageways 48, 50, 52, 56, and 62. This pressurization is coupled via vent 64 to one side of membrane 66, causing deformation of membrane 66 as shown in FIG. 5, closing an electrical circuit between contacts 70 and 72 by moving contact 70 into abutment with contact 72. Deactuation of switch 54 is accomplished by release of button or aperator 24, thus releasing the temporary air pressurization of passageways 48-62, allowing membrane 66 to relax to the position shown in FIG. 4. It is to be understood that moveable contact 70 is preferably resilient and will tend to return from the position shown in FIG. 5 to that shown in FIG. 4 upon release of button 24 since contact 70 has resilient leaf-spring portion 71.

The invention is not to be taken as limited to all of the details thereof as modifications and improvements may be made while remaining within the spirit and scope of the invention as claimed. For example, ring 96 may have a vee-shaped circular projection or ridge facing membrane 66 to more positively secure membrane 66 in housing 60.

What is claimed is:

1. In an air actuated switch of the type having a manually-operable, resiliently deformable operator at a distal end of an air passageway and a resilient membrane pneumatically driven by said operator for actuating an electrical switch at a proximal end of said passageway wherein said switch is actuated when said operator is manually depressed and said switch is deactuated when said operator is released, the improvement in combination therewith comprising a rigid disk member pivotably received in a switch housing, said disk member:

a. having an axially displaced actuated position wherein said disk member acts directly against a leaf-spring portion of a first of a pair of contacts comprising said switch to urge said first contact against a second of said pair of contacts, thereby actuating said electrical switch when said operator is depressed and b. having a deactuated position wherein said leaf spring portion urges said disk member toward a smooth, substantially uninterrupted planar back wall of said housing wherein said smooth, substantially uninterrupted planar back wall extends radially at least co-extensively with said disk member, permitting deactuation of said electrical switch when said operator is released, such that said disk member flattens said membrane against said back wall of said housing in the deactuated position over an area at least co-extensive with said disk member to retard permanent deformation of said resilient membrane.

2. The switch improvement of claim 1 wherein said pair of contacts are in a normally-open circuit configuration when said disk member is in said deactuated position, and further wherein said contacts are in a closed circuit configuration when said disk member is in said actuated position.

3. The switch improvement of claim 1 wherein said disk member distributes the load imposed on said membrane by said electrical switch.

4. The switch improvement of claim 1 wherein the rigid disk member is angularly displaced to the actuated position.

5. The switch improvement of claim 4 further comprising a rigid projection on a cover portion of a housing of said switch, said projection resisting axial movement of said disk member at a location substantially on the periphery thereof.

6. In a method of pneumatically actuating an electrical switch in a switch housing by pneumatically operating a resilient membrane coupled to the switch, the improved method in combination therewith comprising:

(a) interposing a rigid disk between said membrane and said electrical switch such that said membrane displaces said disk directly against a leaf-spring portion of a first of a pair of contacts comprising said switch to urge said first contact against a second of said pair of contacts when said membrane is deformed (b) surrounding said disk with a ring such that:

(i) said disk is received in said ring when said switch is deactuated, and (ii) said disk is at least partially displaced from said ring when said switch is actuated, and (c) urging said disk by said leaf-spring portion against a smooth, substantially uninterrupted planar back wall of said housing wherein said smooth, substantially uninterrupted planar back wall is radially at least coextensive with said disk to retard permanent deformation of said membrane by said disk when the switch is deactuated.

7. The method of claim 6 wherein said disk distributes the load imposed on said membrane by said switch.

8. The method of claim 6 further comprising:

(c) pivoting said disk against a stationary projection acting against a location on the periphery of said disk such that movement of said membrane is amplified by said pivoting.

9. In a portable painting system of the type having a paint reservoir and a pump in communication with a paint applicator such as a brush, via a paint supply line, an improved switch-actuated paint supply system comprising:

(a) a portable paint reservoir;

(b) an electrical paint pump for pumping paint from said reservoir;

(c) a paint supply line connected to said pump for supplying paint;

(d) a paint applicator connected to said paint supply line;

(e) a pneumatically actuated electrical switch for energizing said pump, said switch comprising:

(i) a remote pneumatic operator for pressurizing a switch control line, (ii) a membrane deformable upon pressurizing a switch control line, and (iii) a rigid disk interposed between said membrane and a first of a pair of contacts comprising said switch, such that displacement of said membrane is amplified by said disk to act directly against a leaf-spring portion of said first contact to urge said first contact in a switch-actuated position against a second of said pair of contacts upon pressurization of said switch control line, wherein said disk is urged by said leaf-spring portion to flatten said membrane against a smooth, substantially uninterrupted planar back wall of said housing in a switch-deactuated position wherein said smooth, substantially uninterrupted planar back wall is radially at least co-extensive with said disk to retard permanent deformation of said membrane by said disk upon release of pressurization of said switch control line.

10. The system of claim 9 wherein said disk is substantially congruent and adjacent to said deformable membrane such that said membrane is urged to a planar configuration by said first contact acting through said rigid disk upon depressurization of said switch control line.

11. The system of claim 9 wherein said disk amplifies said membrane displacement by pivoting against a fixed projection located at the periphery of said disk.

12. The system of claim 11 wherein said disk acts on said first contact generally diametrically opposite said projection.

* * * * *